US007102538B2

(12) United States Patent
Chen

(10) Patent No.: US 7,102,538 B2
(45) Date of Patent: Sep. 5, 2006

(54) LED SIGNAL LIGHT

(76) Inventor: Kuo-Chin Chen, No. 14, Houbu Li, Tuku Township, Yunlin County (TW)

( * ) Notice: Subject to any disclaimer, the term of this patent is extended or adjusted under 35 U.S.C. 154(b) by 178 days.

(21) Appl. No.: 10/816,906

(22) Filed: Apr. 5, 2004

(65) Prior Publication Data

US 2005/0218834 A1 Oct. 6, 2005

(51) Int. Cl.
*G08G 1/95* (2006.01)

(52) U.S. Cl. ..... 340/907; 340/910; 340/917; 340/924; 315/312; 315/360; 315/362; 362/498; 362/545

(58) Field of Classification Search ..... 315/312, 315/292, 291, 360, 362; 340/907, 910, 916, 340/925, 931, 924, 917; 701/117, 114, 115; 348/143, 149; 362/464, 466, 498, 545, 800
See application file for complete search history.

(56) References Cited

U.S. PATENT DOCUMENTS 3,254,324 A * 5/1966 Casciato et al. ..... 340/909
4,167,784 A * 9/1979 McReynolds et al. ..... 701/117
5,132,682 A * 7/1992 Higgins et al. ..... 340/931
5,457,450 A * 10/1995 Deese et al. ..... 340/912
5,880,682 A * 3/1999 Soulliard et al. ..... 340/907
5,898,389 A * 4/1999 Deese et al. ..... 340/907
6,111,523 A * 8/2000 Mee ..... 340/937
6,211,626 B1 * 4/2001 Lys et al. ..... 315/291
6,466,260 B1 * 10/2002 Hatae et al. ..... 348/149
6,856,344 B1 * 2/2005 Franz ..... 348/143
6,879,263 B1 * 4/2005 Pederson et al. ..... 340/815.45
2005/0156103 A1 * 7/2005 May et al. ..... 250/228

* cited by examiner

*Primary Examiner*—Haissa Philogene
(74) *Attorney, Agent, or Firm*—Lowe Hauptman and Berner

(57) ABSTRACT

The present invention provides an LED signal light device comprising a central processing unit, a control panel, an LED signal light, an output and input interface, a battery and an adapter. The central processing unit comprises a microprocessor, a memory and an interface circuit for controlling the operation of the whole device, and outputting a signal and receiving a command through the output and input interface. The control panel is a printed circuit board recorded a circuit therein. The LED signal light consists of plural LEDs, which are three coloring LEDs or color changing LEDs. The LEDs actively show a light display in a closed circuit and show various colors accompanying with various arrangements into abstract symbols for indicating various traffic situations. The device can be connected to an AC power supply of 110 V or 220 V, and the AC power is converted to DC power by an adapter, which also stabilizes the current provided to the whole device. The battery alternatively is provides power to the whole device with its storage power when the power source is ineffective.

8 Claims, 3 Drawing Sheets

LED SIGNAL LIGHT

FIELD OF THE INVENTION

The present invention relates to an LED signal light, in which the light display of the LED signal light is controlled by the central processing unit and the control panel. The LED signal light can show various colors and abstract symbols in a single light device for indicating various traffic situations.

BACKGROUND OF THE INVENTION

The traffic lights are commonly used at road junctions to indicate the traffic situations to the driver. Although the traffic lights are used for a long time, they have the following disadvantages:

(1) The signal light composed of three lights is used at an intersection. It is not economical and causes a great waste.

(2) The policy of each institute usually differs from others to suit local circumstances. For example, turning right upon a red light is permitted at some road sections but is forbidden at some other road sections. The conventional traffic light usually adds another indication light in addition to the three main lights and has no unity. Therefore, it is a trouble for a driver who comes from a foreign region or is unfamiliar with the local situation, and accidents are thus increase.

(3) Since the living pace is getting rapider and rapider, many drivers are impatient for waiting the indication of the signal light. Some drivers turn to watch the traffic light of the traverse intersection or the passing time display for the pedestrian, and start to speed up when the traffic light of the traverse intersection is twinkling or turns to the yellow light. As a result, traffic accidents happen frequently due to the disregard of the coming cars from the other side.

Therefore, the conventional traffic light has many defects, so it is not a good design and should be improved.

Because of the above-described disadvantages generated from the conventional traffic light, the applicant keeps on carving unflaggingly to develop the LED signal light of the present invention through wholehearted experience and research.

SUMMARY OF THE INVENTION

It is an object of the present invention to provide an LED signal light, which includes functions of the conventional traffic lights in a single signal light, owns economic benefits and unity, and can meet the needs of different situations.

It is another object of the present invention to provide an LED signal light, which employs color changing LED or three coloring LED having advantages of high stability and easy assembly.

It is a further object of the present invention to provide an LED signal light having a function of time display.

To achieve the above objects, the present invention improves the conventional traffic light, which adds an attachment lens outside the light bulbs, and uses a light emitting diode (LED) or color changing LED as the light source. In which, the LED elements of red, yellow and green colors are arranged and constitutes the signal light, or the color changing LED is controlled by the voltage.

Compared to the conventional light bulb, LED has advantages of high reliability, long life span (it can be continuously used for one hundred thousand to one million hours), and high lighting efficiency. In addition, if parts of the elements are damaged, only the damaged parts need to be changed, rather than changing the whole set of the light. It can also cooperate with other semiconductor components, and its color can be controlled by a control panel.

The LED signal light device comprises a central processing unit, a control panel, an LED signal light, an output and input interface, a battery and an adapter. The central processing unit comprises a microprocessor, a memory and an interface circuit for controlling the operation of the whole device, and outputting a signal and receiving a command through the output and input interface. The control panel is a printed circuit board recorded a circuit or relevant parameter data therein. The LED signal light consists of LEDs of red, yellow and green colors, or color changing LEDs. The LEDs actively show a light display in a closed circuit and show various colors accompanying with various arrangements into abstract symbols for indicating various traffic situations. The device can be connected to an AC power supply of 110 V or 220 V, and the AC power is converted to DC power by an adapter, which also stabilizes the current provided to the whole device. The battery alternatively provides power to the whole device with its storage power when the power source is ineffective.

BRIEF DESCRIPTION OF THE DRAWINGS

The present invention may best be understood through the following description with reference to the accompanying drawings, in which.

DETAILED DESCRIPTION OF THE PREFERRED EMBODIMENT

For the convenience of explicitly understanding the structure, usage and feature of the present invention, the following preferred embodiments, accompanying with the detailed description of drawings, are illustrated.

Figure 1:
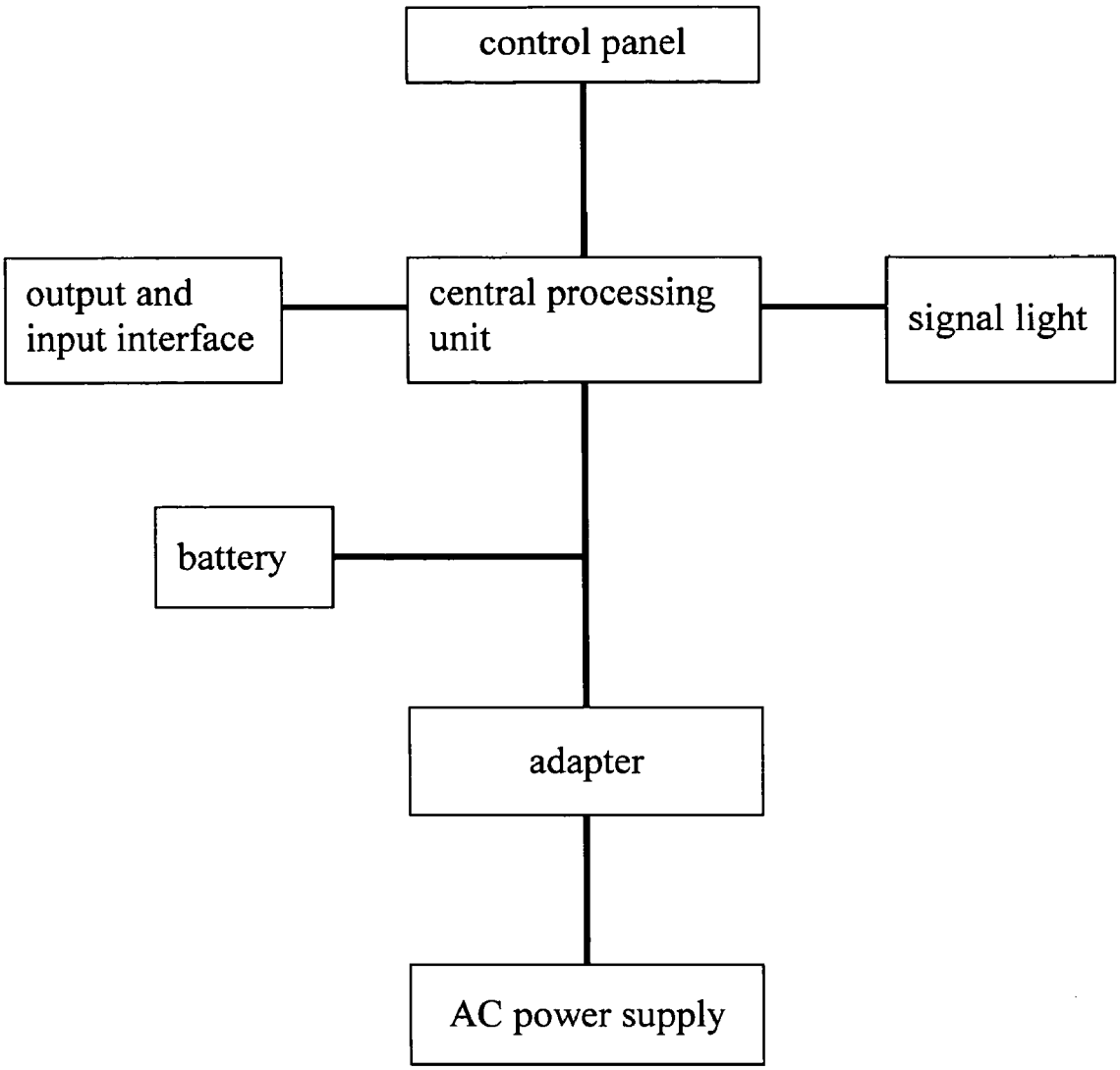
FIG. 1 shows a schematic view of the circuit block of the LED signal light in the present invention.

Please refer to FIG. 1 showing a schematic view of the circuit block of the present invention. The device of the present invention can be connected to an AC power supply 7 of 110 V for common uses or 220 V for industrial uses. The AC power supply 7 is the power source of the whole device, and the AC is converted to DC, which is required for the inner circuit of the present invention, by an adapter 5. The adapter 5 can also stabilize the voltage of the AC power supply 7 to protect the inner circuit components of the present invention. The battery 6 is a power storage device. If the power is normally provided by the AC power supply 7 and the power storage in the battery 6 is saturated, the battery 6 has no function. But if the AC power supply 7 is short or ineffective, the battery 6 alternatively provides the power to the whole device with its storage power, and can store power again when the AC power supply 7 can normally provide the power. The central processing unit 1 of the present invention includes a microprocessor, a memory and an interface circuit for controlling the operation of the whole device, such as the light display, twinkling, and lighting time of LED components of the signal light 3, the signal input and output, the message processing, and operation of the predetermined program. The central processing unit 1 can collocate with various control panels 2. The control panel 2 can be a printed circuit board (PCB), which has been recorded in advance the program control, the parameter setting for the condition, and so on. Via an output and input interface 4, the central processing unit 1 can be connected to various peripheral equipments, such as a camera, a transceiver and a sensor, or output the processes signal and receive the instruction signal input.

Figure 2:
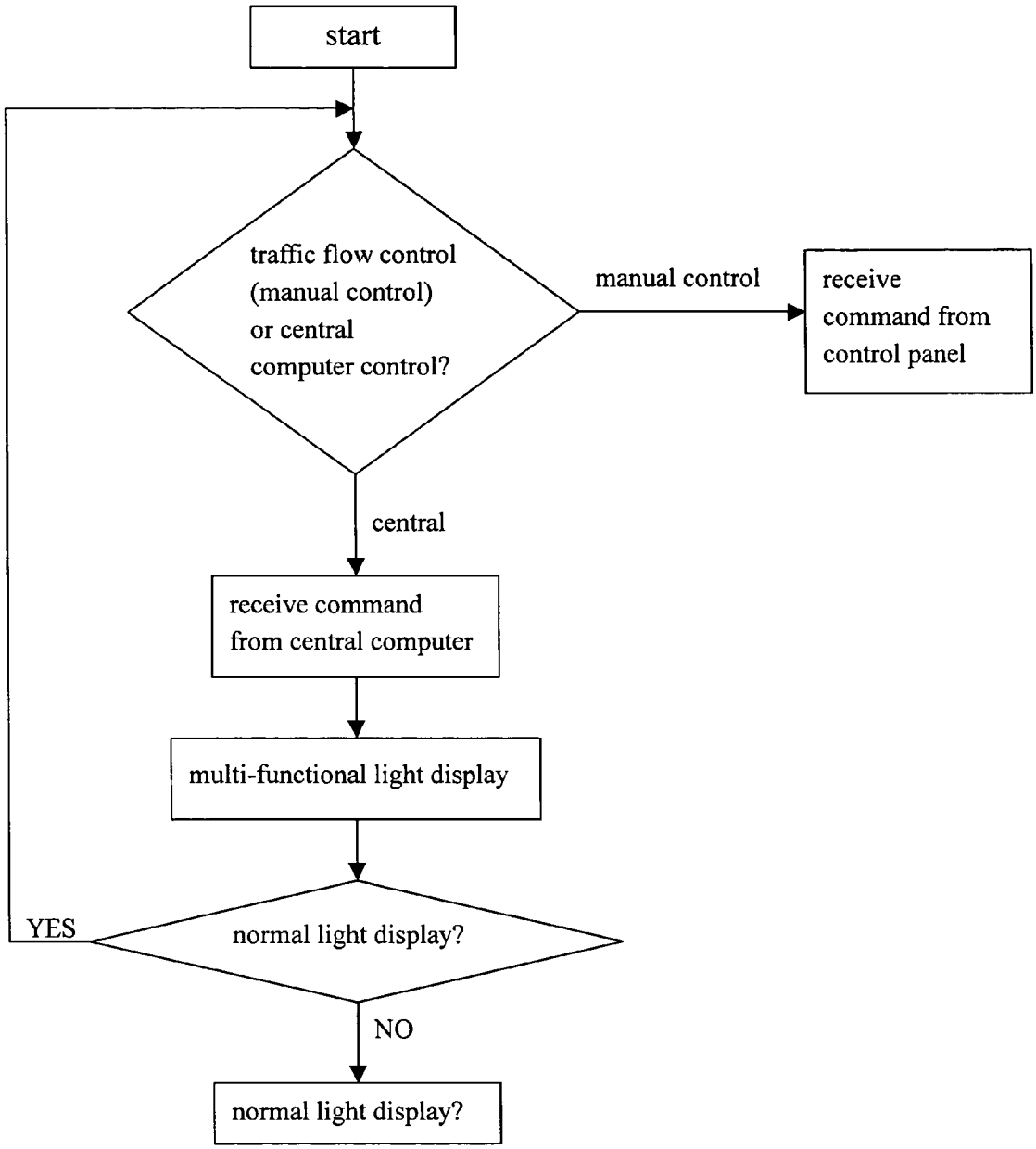
FIG. 2 shows a flow chart of the LED signal light in the present invention.

Please refer to FIG. 2 showing a flow chart of the present invention. The device according to the preferred embodiment of the present invention is started 11 first to be operated normally. In the meantime, the light of the device can be master controlled by traffic flow (manual control) or central computer modes 12. If it is manually controlled, the device of the present invention receives the panel control instruction 13, and the instructed action is performed by the central processing unit 1. Or it can be connected to the central computer of the traffic institution via the output and input interface 4, received the control instruction 14 from the central computer, and overall managed by the central computer of the traffic institution according to the whole traffic situation. The present invention operates the light display of the LED signal light according to the instruction from the central computer. During the operation, the central processing unit 1 of the present invention determines whether the signal light is normally displayed or not depends on the LED circuit is closed or open. If there is something wrong in the device, the central processing unit 1 sends out an emergent repair notification 17 through the output and input interface 4 to inform the subsequent repairing unit to restore the device.

Figure 3:
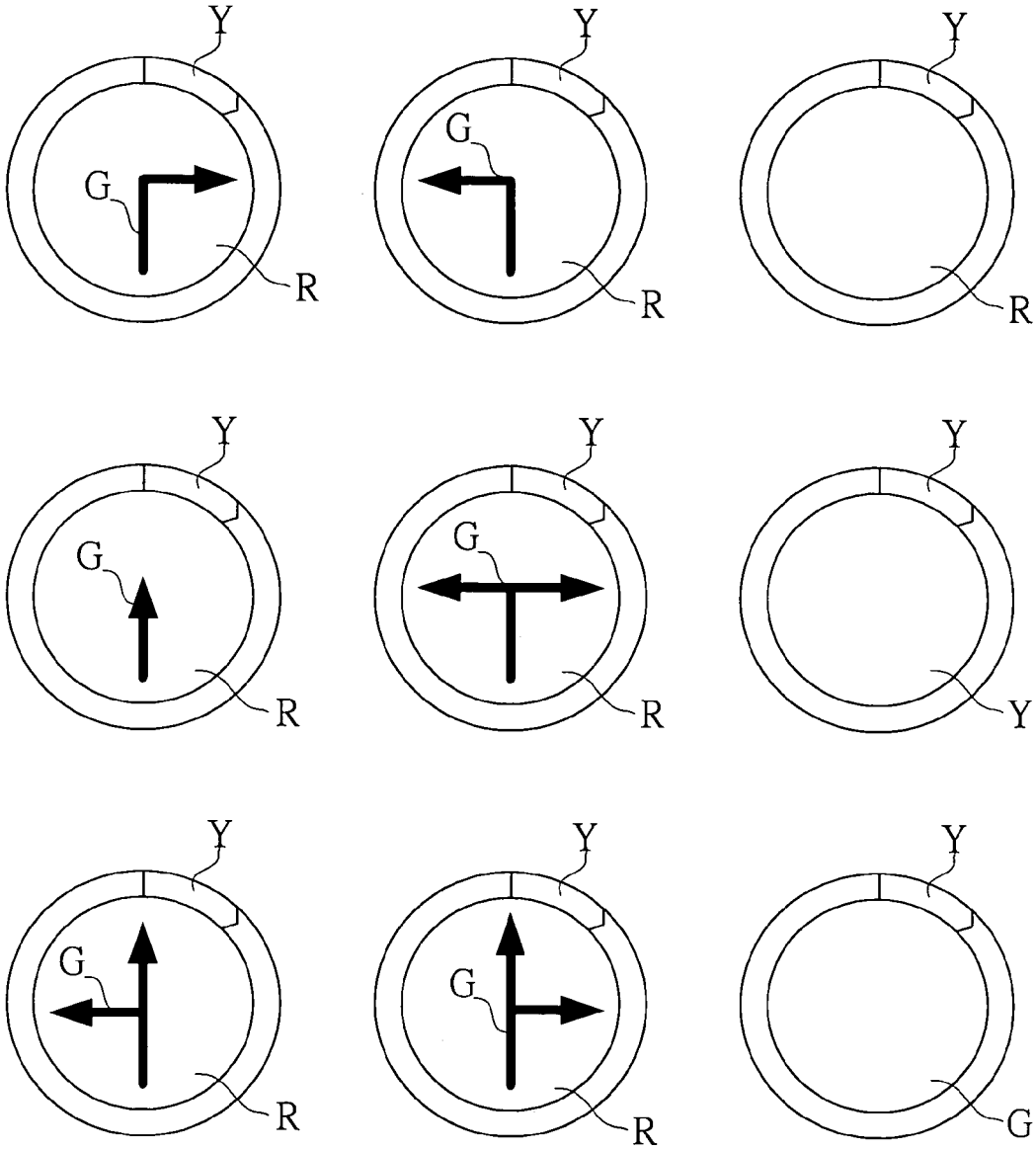
FIG. 3 shows a schematic view of the light display of the LED signal light in the present invention.

Please refer to FIG. 3 showing a schematic view of the light display of the present invention. There are 3×3 kinds of the display condition, in which R represents red, G represents green, and Y represents yellow. The LED signal light provided by the present invention shows an appearance of red, yellow and green colors, direction indication arrows and the symbol of the light display time. As shown in FIG. 3, the small concentric circle area shows three kinds of bottom colors of red by the LED, yellow and green colors, and the driver can understand the indications, such as go straight, no left turn or no right turn and so on, according to the direction indication arrows. The area between the small concentric circle and the large concentric circle shows the yellow symbol of the light display time. When the bottom color is lighting, the area is completely lighting at first, and as the display time of the bottom color light passes gradually, the length of the area is getting shorter toward the anticlockwise direction. Until the light of the whole area disappears, i.e. the display time of the bottom color light is over, the bottom color light changes. The display time can also be shown as numerals. Except the light display, the light can be twinkled to attract the attention of the driver. Therefore, it is clear at first sight that when the left turn, right turn or straight going is permitted, when the left turn, right turn or straight going is forbidden, or how long is left for the display time. Therefore, no matter the driver or pedestrian comes from a foreign region or is a local resident, he can follow the traffic signal light easily.

While the invention has been described in terms of what are presently considered to be the most practical and preferred embodiments, it is to be understood that the invention need not be limited to the disclosed embodiment. On the contrary, it is intended to cover various modifications and similar arrangements included within the spirit and scope of the appended claims that are to be accorded with the broadest interpretation so as to encompass all such modifications and similar structures.

What is claimed is:

1. An LED traffic signal light device, comprising:

a light display housing having a pair of concentric circular portions wherein an annular illuminating area is created between said pair of concentric circular portions;

a central processing unit consisting of a microprocessor, a memory and an interface circuit disposed within said light display housing and for controlling the operation of the whole device and outputting a signal and receiving a command via an output and input interface;

a control panel being a printed circuit board and recording a circuit and relevant parameters therein in advance;

an LED signal light consisting of plural LEDs which actively show a light display in a closed circuit and show various colors accompanying with various arrangements into abstract symbols for indicating various traffic situations;

said output and input interface provided for said central processing unit to output a signal or receive an external command signal through said interface; and an adapter provided for converting an AC to a DC and stabilizing the current provided to the whole device, and wherein the illuminated length of the annular area between said pair of concentric circles becomes shorter in a counter clockwise direction as the LED traffic signal device is changing from displaying one traffic signal to another.

2. The LED traffic signal light device according to claim 1, further comprising a battery for alternatively providing power to the whole device with its storage power when the AC power source is ineffective.

3. The LED traffic signal light device according to claim 1, wherein said device is connected to an AC power supply.

4. The LED traffic signal light device according to claim 1, wherein said LED is monochromatic LED selected from a group consisting of a red LED, a green LED and a yellow LED.

5. The LED traffic signal light device according to claim 1, wherein said LED is a color changing LED showing a light of a particular color under different particular voltages.

6. The LED signal light device according to claim 5, wherein said particular color is red, yellow or green.

7. The LED traffic signal light device according to claim 1, wherein said LED signal light shows a light display time via the LED lighting areas or numerals.

8. The LED traffic signal light device according to claim 1, wherein said LED signal light is displayed with a twinkled light.

* * * * *